US010790600B2

(12) United States Patent
Purdy et al.

(10) Patent No.: US 10,790,600 B2
(45) **Date of Patent: *Sep. 29, 2020**

(54) CONNECTORS FOR USE IN HIGH PRESSURE COAX CORE EJECTION AND FIBER OPTIC CABLE INJECTION

(71) Applicant: PPC Broadband, Inc., East Syracuse, NY (US)

(72) Inventors: Eric Purdy, Constantia, NY (US); Richard Maroney, Camillus, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/506,834

(22) Filed: Jul. 9, 2019

(65) Prior Publication Data

US 2019/0334258 A1 Oct. 31, 2019

Related U.S. Application Data

(63) Continuation of application No. 15/296,026, filed on Oct. 17, 2016, now Pat. No. 10,348,004.

(60) Provisional application No. 62/242,987, filed on Oct. 16, 2015.

(51) Int. Cl.

| | |
|---|---|
| ***H01R 43/26*** | (2006.01) |
| ***H01R 9/05*** | (2006.01) |
| ***H01R 4/2475*** | (2018.01) |

(52) U.S. Cl.

CPC ..... *H01R 9/0524* (2013.01); *H01R 4/2475* (2013.01); *H01R 43/26* (2013.01)

(58) Field of Classification Search

CPC ..... H01R 9/0524; H01R 43/26; H01R 4/2475

USPC ..... 439/100, 578; 174/84 R, 88 C

See application file for complete search history.

(56) References Cited

U.S. PATENT DOCUMENTS 3,778,535 A * 12/1973 Forney, Jr. ..... H01P 1/045 174/880

5,364,281 A * 11/1994 Leto ..... H01R 4/60 403/378

6,634,906 B1 * 10/2003 Yeh ..... H01R 9/0518 439/578

6,712,631 B1 3/2004 Youtsey (Continued)

OTHER PUBLICATIONS

Jan. 12, 2017 International Search Report issued in International Application No. PCT/US16/57430.

*Primary Examiner* — Sherman Ng

(74) *Attorney, Agent, or Firm* — MH2 Technology Law Group, LLP

(57) ABSTRACT

A connector includes a first connector body having a through hole configured to receive a conduit, a first washer disposed in the first connector body, the first washer being configured to permit the conduit to be pushed in a first direction through the through hole while resisting movement of the conduit in a second direction opposite to the first direction, a second connector body configured to be coupled to the first connector body, the second connector body having a through hole configured to receive a tubular member, and a second washer disposed in the second connector body, the second washer being configured to permit the tubular member to be pushed in the second direction through the through hole of the second connector body and into the second connector body while resisting movement of the tubular member in the first direction.

20 Claims, 7 Drawing Sheets

(56) References Cited

U.S. PATENT DOCUMENTS

| | | | | |
|---|---|---|---|---|
| 7,942,695 | B1 * | 5/2011 | Lu | H01R 13/111 439/578 |
| 8,007,284 | B2 * | 8/2011 | Smith | F16L 25/01 439/32 |
| 2003/0224657 | A1 * | 12/2003 | Malloy | H01R 9/0521 439/578 |
| 2011/0143567 | A1 | 6/2011 | Purdy et al. | |
| 2011/0308855 | A1 * | 12/2011 | Marsh | H01R 9/0527 174/74 R |
| 2012/0045933 | A1 | 2/2012 | Youtsey | |

* cited by examiner

CONNECTORS FOR USE IN HIGH PRESSURE COAX CORE EJECTION AND FIBER OPTIC CABLE INJECTION

CROSS-REFERENCE TO RELATED APPLICATIONS

This is a continuation of application Ser. No. 15/296,026, filed Oct. 17, 2016, pending, which claims the benefit of U.S. Provisional Application No. 62/242,987, filed on Oct. 16, 2015. The disclosure of the prior applications is hereby incorporated by reference herein in its entirety.

BACKGROUND

Consumer requests for Video on Demand, high definition content, and DOCSIS® 3.0 data services is consuming ever-increasing amounts of network capacity. Also, the pursuit of "green" business practices has become desirable. Cable operators are able to increase network bandwidth significantly, while simultaneously lowering energy consumption and improving operational efficiency, by driving fiber deeper into the network and reducing the number of homes served per node, for example, from 500 to 2,000 homes in a traditional hybrid fiber coax (HFC) architecture to typically around 100 homes.

By pushing fiber deeper into the network, typically within a few hundred feet of the subscribers' homes, the optical-to-electrical conversion of downstream signals occurs much closer to subscribers' homes, which eliminates the need for RF amplifiers in the coax plant, thereby achieving significant green benefits. With the length of the coaxial cable runs shortened, that portion of the network becomes entirely passive. As this reduces the size of node service areas, it in turn results in an increase of the narrowcast bandwidth available to individual subscribers.

Conventional construction methods for installing fiber optic micro cable deeper into the network require digging, trenching, boring, and restoration. Such methods impact customer landscaping, lawns, and other utilities including water, power, and gas lines.

More recently, alternative fiber deployment techniques have been developed whereby cable operator coaxial cables are converted to fiber-optic cables, which allows the operator to deploy fiber deeper in the network. These techniques remove the dielectric and center conductor of a hardline coax cable, while leaving the aluminum shield of the hardline coax in place for use as a conduit or micro-duct for installing fiber optic micro cable. These alternative deployment techniques are at substantially lower cost than traditional boring and trenching and take a fraction of the time. By avoiding digging, trenching, boring, and restoration, impacts to customer landscaping, lawns, and other utilities including water, power, and gas lines are avoided.

These alternative techniques typically involve attaching a hydraulic fitting to an end of an existing coax cable and injecting a biodegradable soap solution into the coax under pressure. This fluid compresses the foam core, breaking it from the shield, and pushes it out the far end. The remaining aluminum shield of the hardline coax is cleaned and then used as a conduit or micro-duct for installing fiber optic micro cable. These techniques are referred to as high pressure coax core ejection and fiber optic cable injection ("coax ejection and fiber injection techniques").

In order to create longer continuous lengths of hollowed-out coax cables, separate spans of coax cables that terminate at a pedestal or other splice point can be connected by plastic (e.g., high density polyethylene (HDPE)) tubing and airtight fittings. The plastic innerduct can later be cut, and the fiber optic cable can be terminated with appropriate fiber connectors for the network.

The coax ejection and fiber injection techniques require a special connector to be attached to the end of the coax cable to accommodate the hydraulic fitting used in the core ejection process and another special connector to facilitate injection of the fiber optic cable. Still another connector is required for connecting the plastic tubing to the aluminum shield of the hardline coax remaining after the coax ejection.

It may be desirable to provide a connector for use in coax ejection and fiber injection techniques that can accommodate the hydraulic fitting, facilitate injection of the fiber optic cable, and connect the plastic tubing to the aluminum shield. It may also be desirable to provide a connector that includes a washer for holding a hardline cable in place and preventing the cable from backing out of the connector. Also, it may be desirable to provide a washer that maintains an electrical ground from the hardline cable to a body of the connector even when other parts of the connector are not fully secured.

SUMMARY

According to various aspects of the disclosure, a connector includes a first connector body and a second connector body configured to be coupled to one another. The first connector body has a through hole and a cavity. The through hole and the cavity are configured to receive an aluminum shield of a hardline coaxial cable. A first washer is disposed in the first connector body and is configured to permit the aluminum shield to be pushed in a first direction through the through hole and into the cavity while resisting movement of the aluminum shield in a second direction opposite to the first direction. The second connector body has a through hole and a cavity. The through hole and the cavity of the second connector body are configured to receive a tubular member. A second washer is disposed in the second connector body and is configured to permit the tubular member to be pushed in the second direction through the through hole of the second connector body and into the cavity of the second connector body while resisting movement of the tubular member in the first direction.

In accordance with some aspects of the disclosure, a method of coupling a tubular member to an aluminum shield of a hardline coaxial cable includes installing a first connector body on the aluminum shield, pushing the aluminum shield through a first washer disposed in the first connector body, coupling a second connector body to the first connector body, and pushing the tubular member through a second washer disposed in the second connector body. The first connector body has a through hole and a cavity, and the through hole and the cavity are configured to receive the aluminum shield. The first washer is configured to permit the aluminum shield to be pushed in a first direction through the through hole and into the cavity while resisting movement of the aluminum shield in a second direction opposite to the first direction. The second connector body has a through hole and a cavity, and the through hole and the cavity of the second connector body are configured to receive the tubular member. The second washer is configured to permit the tubular member to be pushed in the second direction through the through hole of the second connector body and into the cavity of the second connector body while resisting movement of the tubular member in the first direction.

DETAILED DESCRIPTION OF THE EMBODIMENTS

FIGS. 1-5 illustrate an exemplary connector 100 in accordance with various aspects of the disclosure. The connector 100 includes a first connector portion 110 and a second connector portion 150 that are coupleable to one another.

Figure 1:
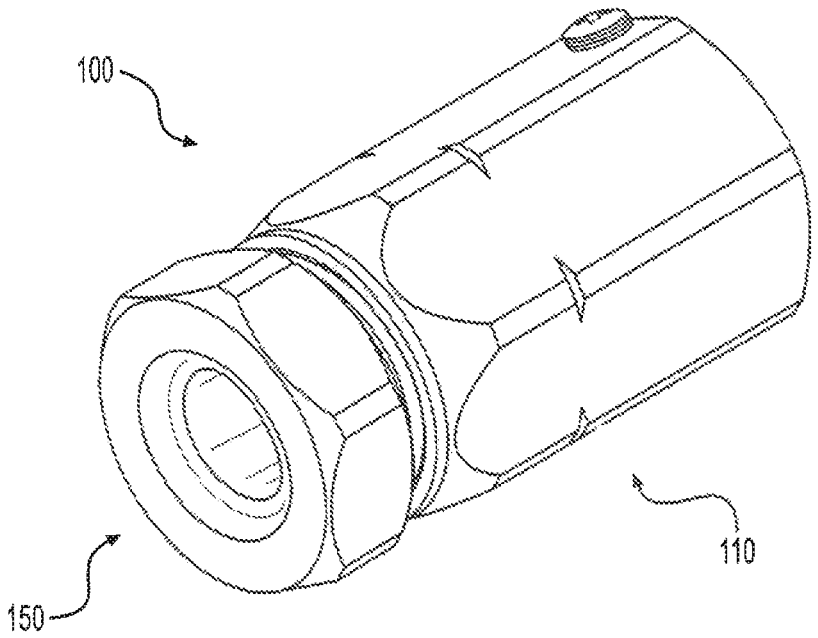
FIG. 1 is a perspective view of an exemplary connector in accordance with various aspects of the disclosure.
Figure 2:
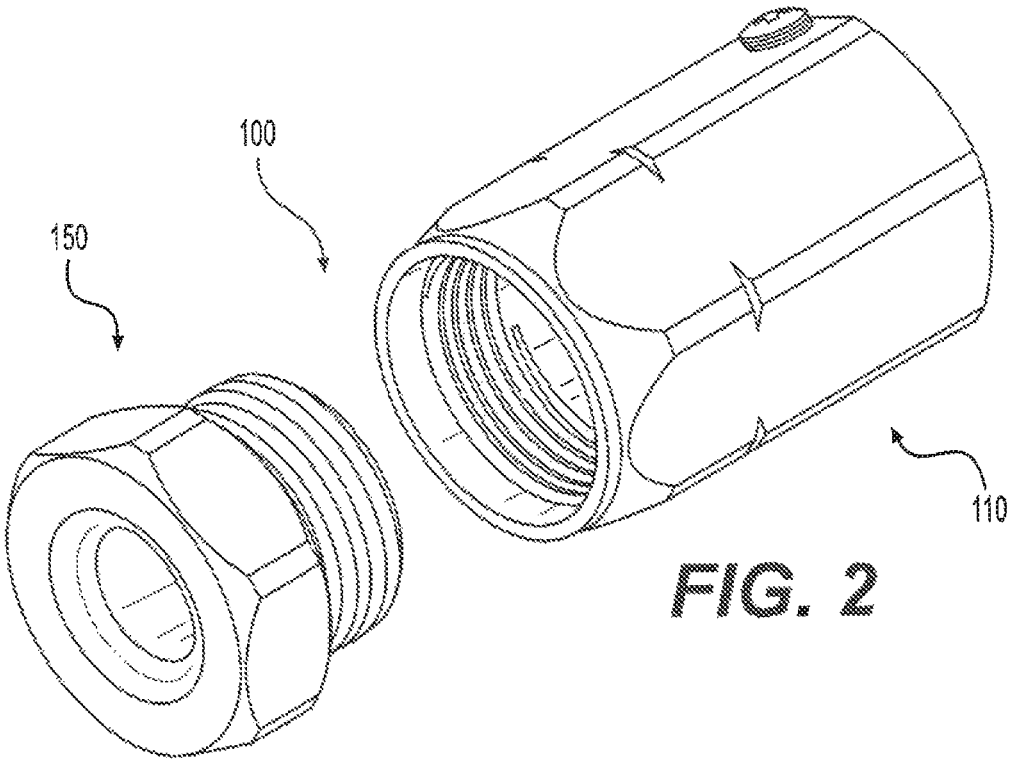
FIG. 2 is another perspective view of the exemplary connector of FIG. 1.
Figure 3:
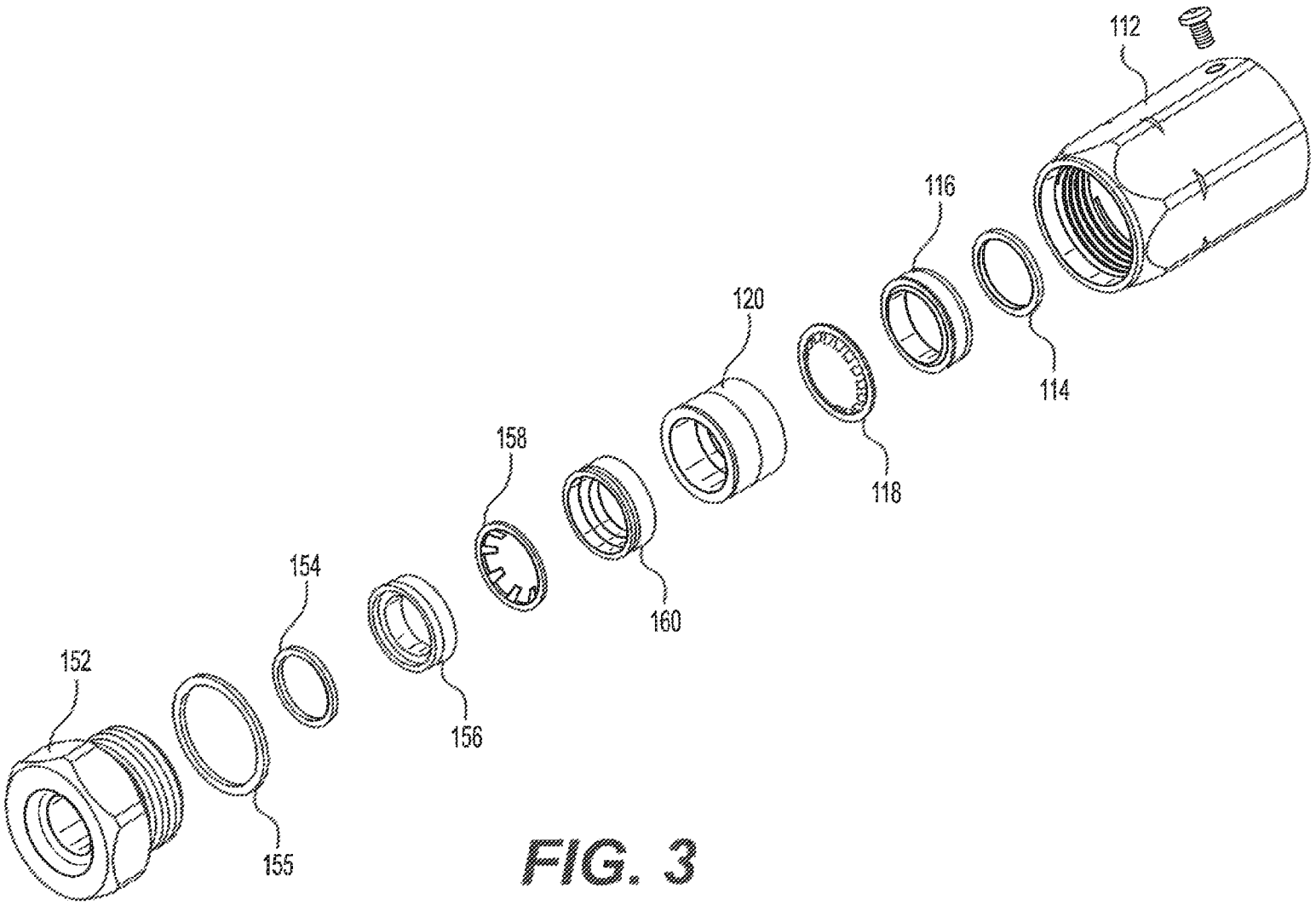
FIG. 3 is an exploded view of the exemplary connector of FIG. 1.
Figure 4:
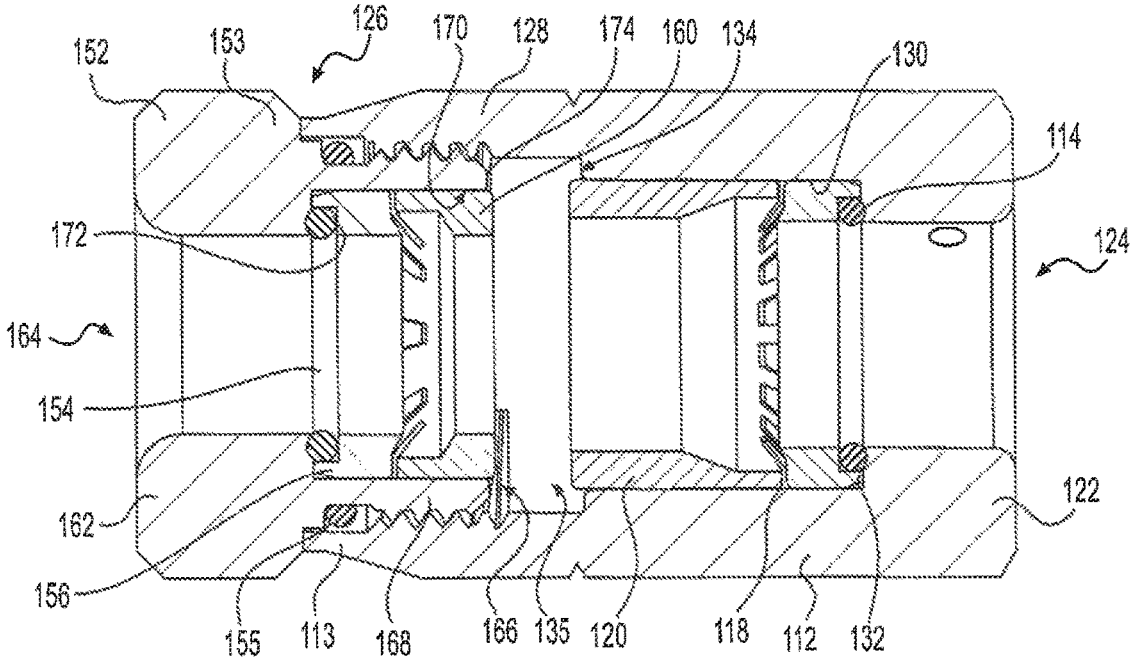
FIG. 4 is a cross-sectional view of the exemplary connector of FIG. 1 in an uninstalled state.
Figure 5:
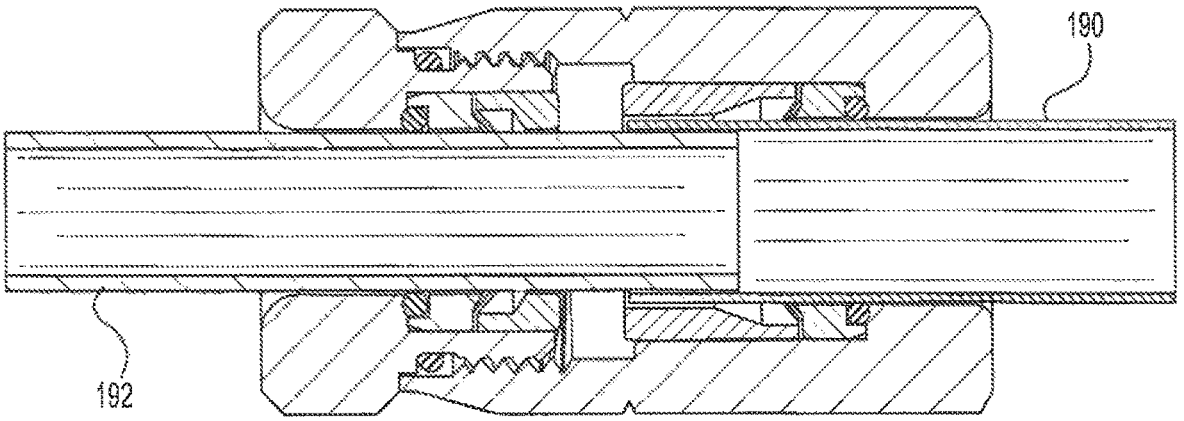
FIG. 5 is a cross-sectional view of the exemplary connector of FIG. 1 in an installed state.

Referring now to FIGS. 3-5, the first connector portion 110 includes a first connector body 112, a first seal 114, a first ring member 116, a first washer 118, and a second ring member 120. The first connector body 112 includes a first end wall 122 having a through hole 124 sized and configured to receive an aluminum shield 190 (FIG. 5) of a hardline coax cable. A second end 126 of the first connector body 112, opposite to the first end wall 122, includes a female threaded portion 128. The first connector body 112 includes a cavity 130 between the first end wall 122 and the female threaded portion 128.

The cavity 130 is configured to receive the first seal 114, the first ring member 116, the first washer 118, and the second ring member 120. The first end wall 122 defines a first shoulder 132 that seats the first seal 114 and first ring member 116. As best shown in FIG. 4, the first ring member 116 sandwiches the first seal 114 against the first shoulder 132. The first washer 118 is sandwiched between the first and second ring members 116, 120 along a longitudinal dimension of the first connector body 112.

According to various aspects, the first connector body 112 may be constructed from aluminum and have a chromate conversion coatings such as, for example, yellow iridite. The first and second ring members 116, 120 may be constructed from brass and may be nickel-plated. The first and second ring members 116, 120 can thus be press-fit into the cavity of the first connector body 112 such that the first and second ring members 116, 120 are held by an interference fit relationship with the first connector body 112. The first washer 118 may also be held by an interference fit relationship with the first connector body 112 so that a continuous ground path from the aluminum shield 190 of the hardline cable, through the first washer 118, and to the first connector body 112 may be provided. The first and second ring members 116, 120 are assembled with the connector body 112 such that the first washer 118 is firmly held in place along the longitudinal dimension to maintain electrical continuity through the first and second ring members 116, 120 and the first washer 118. The first washer 118 is also substantially centered relative to the cavity 130 and the through hole 124.

Referring to FIGS. 4 and 5, the first connector body 112 includes a second shoulder 134 at an end of the cavity 130 opposite to the first shoulder 132. The second shoulder 134 is spaced from the female threaded portion 128 in the longitudinal dimension of the first connector body 112. The second ring member 120 may extend from the cavity 130 beyond the second shoulder 134, but a gap 135 may be maintained between the female threaded portion 128 and the second ring member 120, as will be discussed below.

Figure 6:
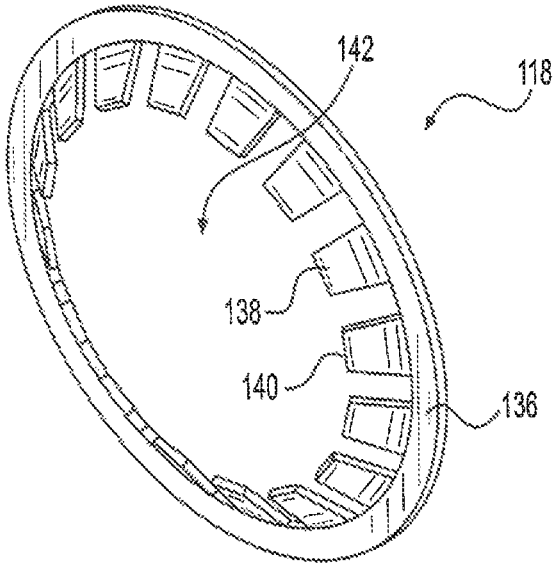
FIG. 6 is a perspective view of a first retaining washer of the exemplary connector of FIG. 1.

Referring to FIG. 6, the first washer 118 may be a stainless steel stamping comprising an annular portion 136 with a plurality of inward-extending fingers 138. The fingers 138 extend from the annular portion 136 at an angle away from the first end wall 122 and toward the second end 126 of the first connector body 112. The second ring 120 may include a tapered inner surface 121 that provides a larger inside diameter at a first end of the second ring 120 that is adjacent to the first washer 118 compared with a second opposite end of the second ring 120 that is away from the first washer 118. The larger inside diameter of the tapered inner surface 121 accommodates the plurality of inward-extending fingers 138 such that the fingers 138 can further deflect toward the second end 126 of the first connector body 112 as the aluminum shield 190 of the hardline cable is inserted into the through hole 124 and through the first washer 118 in a direction from the first end wall 122 toward the second end 126 of the first connector body 112.

The radially inwardmost tips 140 of the fingers 138 define an opening 142 sized and configured to be slightly smaller than an outer diameter of the aluminum shield 190 of a hardline coax cable. When the aluminum shield 190 is pushed through the opening 142 of the first washer 118, the fingers 138 can bend in the longitudinal dimension toward the second end 126 of the first connector body 112 to accommodate the slightly larger aluminum shield 190. Once the first connector body 112 is installed on the aluminum shield 190, the resiliency of the fingers 138 urges the fingers 138 radially inward toward the aluminum shield 190 to provide a gripping force against the aluminum shield 190. The gripping force of the fingers 138 together with the angled orientation of the fingers 138 helps to prevent the first connector body 112 from being removed from the aluminum shield 190 and from being pushed further through the cavity 130.

The second connector portion 150 includes a second connector body 152, a second seal 154, a third seal 155, a third ring member 156, a second washer 158, and a fourth ring member 160. The second connector body 152 includes a first end wall 162 having a through hole 164 sized and configured to receive a tubular member 192 such as, for example, a polyethylene tubing. The tubular member 192 has an outer diameter sized such that the tubular member 192 can be inserted into the aluminum shield 190 (FIG. 5) of the hardline coax cable. A second end 166 of the second connector body 152, opposite to the first end wall 162, includes a male threaded portion 168. The third seal 155 surrounds the second connector body 152 between the male threaded portion 168 and a head 153 of the second connector body.

The second connector body 152 includes a cavity 170 defined by the first end wall 162 and an inner wall of the male threaded portion 128. The cavity 170 is configured to receive the second seal 154, the third ring member 156, the second washer 158, and the fourth ring member 160. The first end wall 162 defines a first shoulder 172 that seats the second seal 154 and third ring member 156. As best shown in FIG. 4, the third ring member 156 sandwiches the second seal 154 against the first shoulder 172. The second washer 158 is sandwiched between the third and fourth ring members 156, 160 along the longitudinal dimension of the second connector body 152.

According to various aspects, the second connector body 112 may be constructed from aluminum and have a chromate conversion coatings such as, for example, yellow iridite. The third and fourth ring members 156, 160 may be constructed from brass and may be nickel-plated. The third and fourth ring members 156, 160 can thus be press-fit into the cavity 170 of the second connector body 152 such that the third and fourth ring members 156, 160 are held by an interference fit relationship with the second connector body 152. The third and fourth ring members 156, 160 are assembled with the second connector body 152 such that the second washer 158 is firmly held in place along the longitudinal dimension. The second washer 158 is also substantially centered relative to the cavity 170 and the through hole 164.

Referring again to FIGS. 4 and 5, the second connector body 152 includes a second shoulder 174 at an end of the cavity 170 opposite to the first shoulder 172. The fourth ring member 160 may extend from the cavity 170 beyond the second shoulder 174, but the gap 135 may be maintained between the fourth ring member 160 and the second ring member 120 when the first and second connector bodies 112, 152 are coupled together, as will be discussed below.

Figure 7:
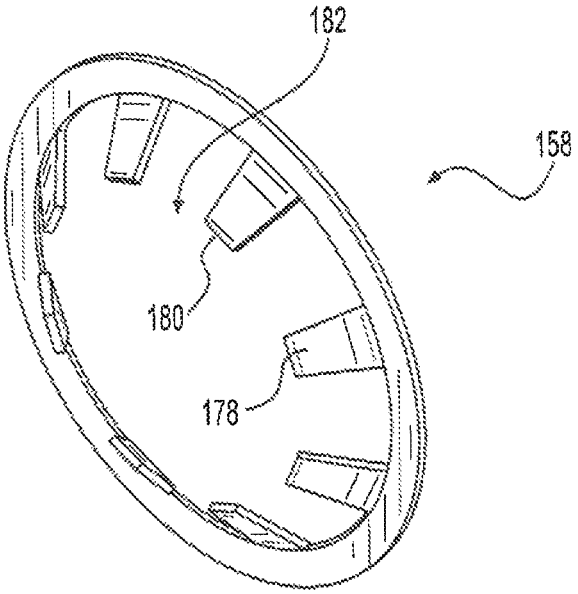
FIG. 7 is a perspective view of a second retaining washer of the exemplary connector of FIG. 1.

Referring to FIG. 7, the second washer 158 may be a stainless steel stamping comprising an annular portion 176 with a plurality of inward-extending fingers 178. The fingers 178 extend from the annular portion 176 at an angle away from the first end wall 162 and toward the second end 166 of the second connector body 152. The radially inwardmost tips 180 of the fingers 138 define an opening 182 sized and configured to be slightly smaller than an outer diameter of the tubular member 192. When the tubular member 192 is pushed through the opening 182 of the second washer 158, the fingers 178 can bend in the longitudinal dimension toward the second end 166 of the second connector body 152 to accommodate the slightly tubular member 192. Once the first connector body 112 is installed on the tubular member 192, the resiliency of the fingers 178 urges the fingers 178 radially inward toward the tubular member 192 to provide a gripping force against the tubular member 192. The gripping force of the fingers 178 together with the angled orientation of the fingers 178 helps to prevent the first connector body 112 from being removed from the tubular member 192, while permitting the tubular member to be inserted further through the second connector body 152 and into the aluminum shield 190.

The first and second connector portions 110, 150 may be coupled to one another via the female threaded portion 138 of the first connector body 112 that receives the male threaded portion 168 of the second connector body 152. The first and second connector bodies 112, 152 may include hexagonal outer surfaces to facilitate tightening of the coupling between the first and second connector bodies 112, 152. When the first and second connector portions 110, 150 may be coupled to one another, the third seal 155 is sandwiched between the head 153 of the second connector body 152 and a longitudinal flange 113 of the first connector body 112 to provide a weatherproof seal between the first and second connector bodies 112, 152. Meanwhile, upon installation, the first seal 114 cooperates with an outer surface of the aluminum shield 190 to provide a weatherproof seal, and the second seal 154 cooperates with an outer surface of the tubular member 192 to provide a weatherproof seal.

In use, the connector 100 is utilized during a process for removing the core (i.e., the center conductor and dielectric) from inside of a hardline coaxial cable to create an open conduit. The connector 100 is then also utilized to facilitate injection of fiber optic cable into the conduit. For example, at a pedestal location, two connectors 100 can be attached to coax ends of two coax runs, and the connectors 100 can facilitate installation of a looping tube between the two coax runs.

The first connector body 112 is installed on a coax end of a first run of hardline cable by pushing the aluminum shield 190 through the through hole 124. The second shoulder 134 and/or the second ring member 120 can serve as an installation guide that indicates how far to push the connector onto the aluminum shield 190. A hydraulic fitting (not shown) may be coupled to the first connector body 112 to facilitate the ejection of the center conductor and dielectric. Once the center conductor and dielectric are ejected from the hardline cable, only the aluminum shield 190 remains. The hydraulic fitting is then removed from the first connector body 112.

The second connector body 152 is then threadably connected with the first connector body 112. The aforementioned installation guide allows the gap 135 to be maintained between the second ring member 120 and the fourth ring member 160. After the first and second connector bodies 112, 152 are assembled together, a first end of the tubular member 192 is inserted through the through hole 164 of the second connector body 152. An inner diameter of the fourth ring member 160 can help guide the tubular member 192 to be inserted into the aluminum shield 190. The aluminum shield 190 has an inner diameter sized to receive the tubular member 192.

A second connector 100 is similarly installed on a second run of hardline cable. A second end of the tubular member 192 is inserted into the second connector 100 and into the aluminum shield of the second run of hardline cable. Fiber optic cable can then be injected through the first run of cable, through the tubular member, and through the second run of cable. The first connector body 112 has a ground screw used to connect a ground path between the two connectors 100 in each pedestal.

At any time after installation of the two connectors 100, the tubular member 192 can be cut between the first and second connectors 100 to expose the fiber optic cables that are in the runs of the aluminum shield 190. Because the second washer 158 permits one-way movement of the tubular member 192, the tubular member 192 can be pushed further into the aluminum shield 190 to unclutter the pedestal.

Referring now to FIGS. 8-12, another exemplary connector 800 in accordance with various aspects of the disclosure is illustrated and described. The connector 800 includes a first connector portion 810 in place of the first connector portion 110 discussed above. The first connector portion 810 is coupleable with the second connector portion 150.

Figure 8:
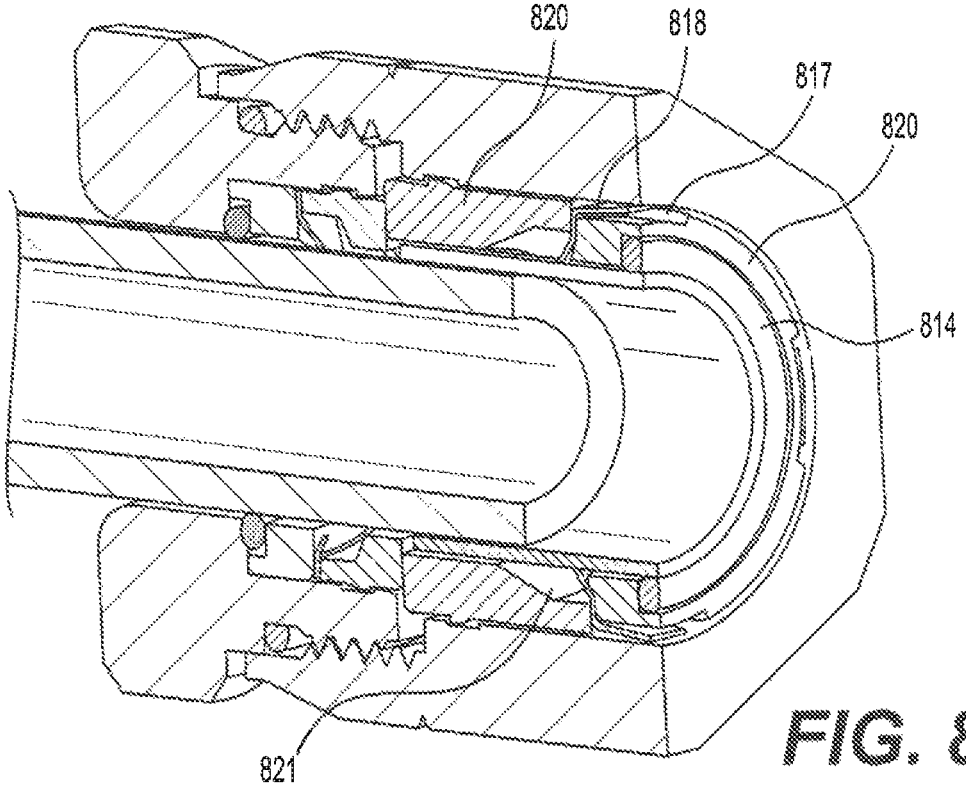
FIG. 8 is a perspective view of another exemplary connector in accordance with various aspects of the disclosure.
Figure 9:
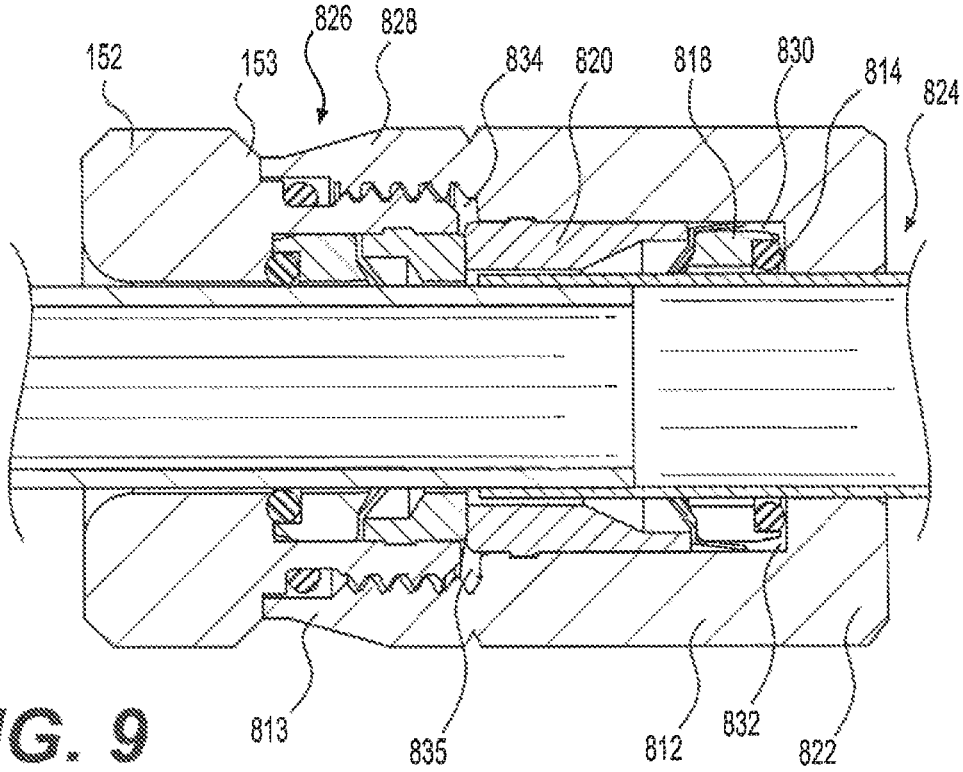
FIG. 9 is a cross-sectional view of the exemplary connector of FIG. 8 in an uninstalled state.
Figure 10:
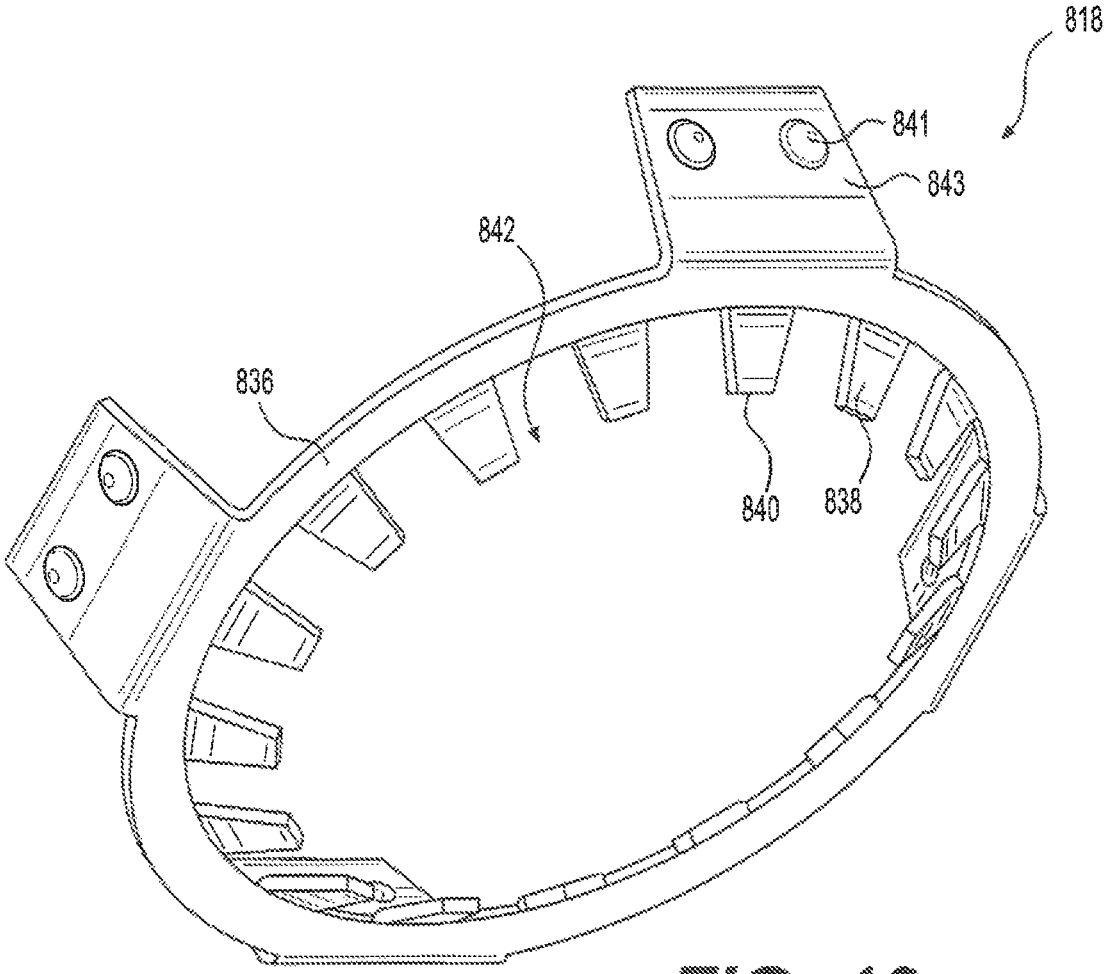
FIG. 10 is a perspective view of a first retaining washer of the exemplary connector of FIG. 8.
Figure 11:
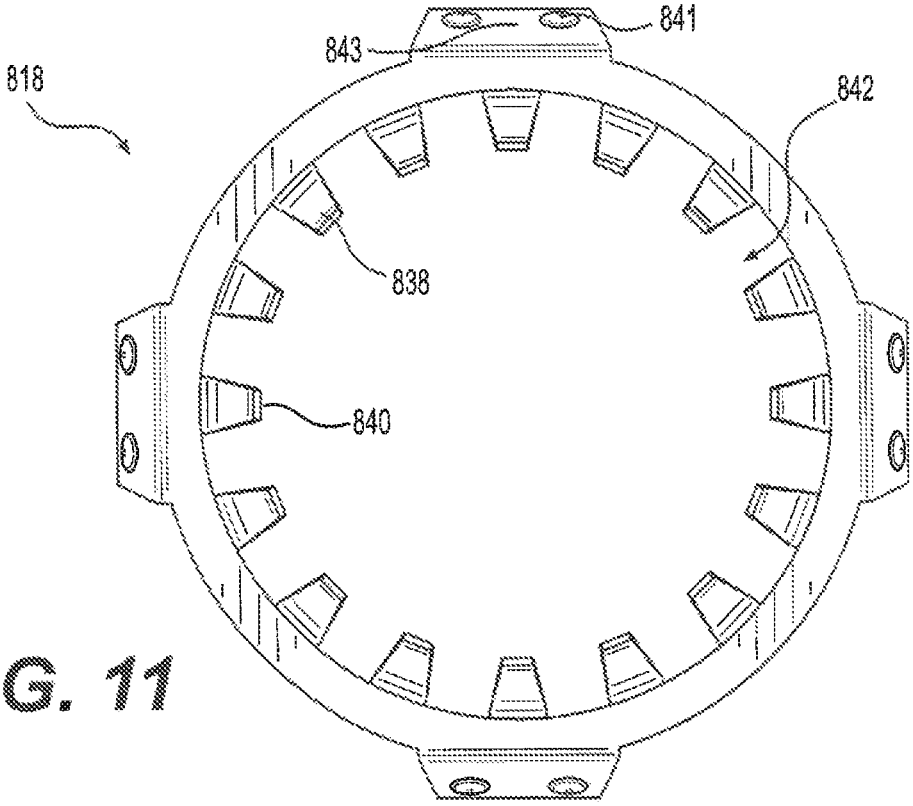
FIG. 11 is a front view of the first retaining washer of FIG. 10.
Figure 12:
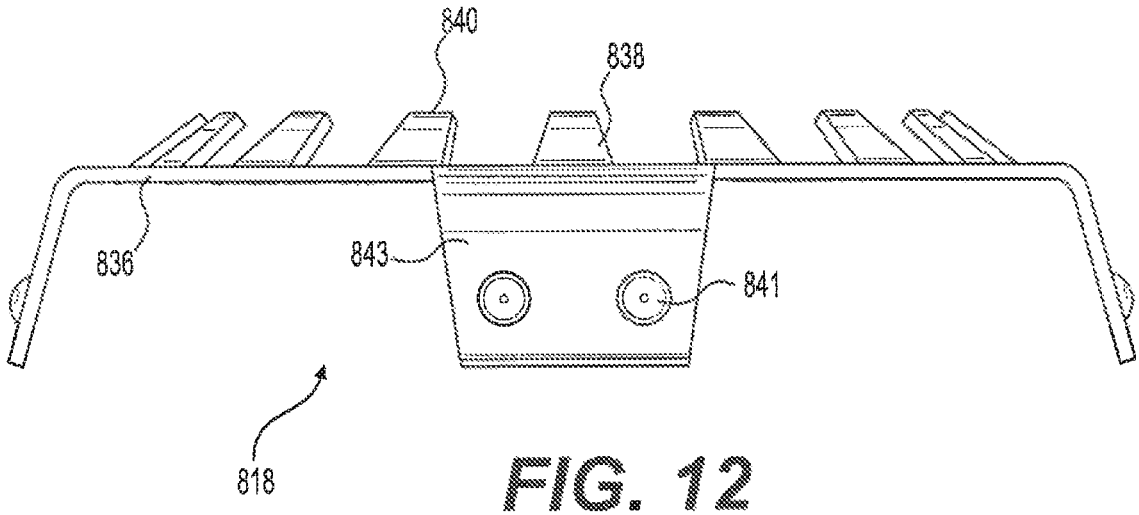
FIG. 12 is a side view of the first retaining washer of FIG. 10.

Referring now to FIG. 8, the first connector portion 810 includes a first connector body 812, a first seal 814, a first ring member 816, a first washer 818, and a second ring member 820. The first connector body 812 includes a first end wall 822 having a through hole 824 sized and configured to receive an aluminum shield 190 (see, e.g., FIG. 5) of a hardline coax cable. A second end 826 of the first connector body 812, opposite to the first end wall 822, includes a female threaded portion 828. The first connector body 812 includes a cavity 830 between the first end wall 822 and the female threaded portion 828.

The cavity 830 is configured to receive the first seal 814, the first ring member 816, the first washer 818, and the second ring member 820. The first end wall 822 defines a first shoulder 832 that seats the first seal 814 and first ring member 816. As best shown in FIG. 4, the first ring member 816 sandwiches the first seal 814 against the first shoulder 832. The first ring member 816 includes one or more notches 817 in its outer peripheral surface 815, as shown in FIG. 8.

According to various aspects, the first connector body 812 may be constructed from aluminum and have a chromate conversion coatings such as, for example, yellow iridite. The first and second ring members 816, 820 may be constructed from brass and may be nickel-plated. The first ring member 816 is sized with an outer diameter that is less than an inner diameter of the cavity 830 of the first connector body 812, which thus permits the first ring member 816 to rotate freely within the first connector body 812. In some aspects, the second ring member 820 may be sized and arranged to rotate freely within the first connector body 812, similar to the first ring member 816. In other aspects, the second ring member 820 can be press-fit into the cavity 830 of the first connector body 812 such that the second ring member 820 is held by an interference fit relationship with the first connector body 812.

The first washer 818 may be a stainless steel stamping comprising an annular portion 836 with a plurality of inward-extending fingers 838 and one or more outward-extending fingers 839. The inward-extending fingers 838 extend radially inward from the annular portion 836 at an angle away from the first end wall 822 and toward the second end 826 of the first connector body 812. Each outward-extending finger 839 extends radially outward from the annular portion 836 at an angle toward the first end wall 822 and away from the second end 826 of the first connector body 812. Each outward-extending finger 839 may include one or more projections or bumps 841 on its outward-facing surface 843. The projections 841 create low friction connection points, which prevent the sharper edges of the outward-extending finger 839 from scratching on an inner surface of the first connector body 812 when the first washer 818 is rotated relative to the connector body 812.

Each outward-extending finger 839 is aligned with a notch 817 in the outer peripheral surface 815 of the first ring member 816. Thus, if the first washer includes a plurality of outward-extending fingers 839, the first ring member 816 includes a like number of notches 817. Also, when the first connector portion 810 includes a plurality of outward-extending fingers 839 and notches 817, the outward-extending fingers 839 and notches are similar spaced about the peripheries of the first washer 818 and the first ring member 816, respectively, such that each outward-extending finger 839 is received in a notch 817. The resiliency of each outward-extending finger 839 urges the respective finger 839 against an inner surface 813 of the connector body 812. Also, the resiliency of each outward-extending finger 839 permits the first washer 818 to move in a radial plane relative to the longitudinal dimension of the first connector portion 810. Further, as long as the first ring member 816 is rotatable relative to the first connector body 812, the first washer 818 is rotatable with the first ring member 816 because the radial walls of each notch 817 can engage a respective outward-extending finger 839 and thereby rotate the first washer 818.

The second ring 820 may include a tapered inner surface 821 that provides a larger inside diameter at a first end of the second ring 820 that is adjacent to the first washer 818 compared with a second opposite end of the second ring 820 that is away from the first washer 818. The larger inside diameter of the tapered inner surface 821 accommodates the plurality of inward-extending fingers 838 such that the fingers 838 can further deflect toward the second end 826 of the first connector body 812 as the aluminum shield 190 of the hardline cable is inserted into the through hole 824 and through the first washer 818 in a direction from the first end wall 822 toward the second end 826 of the first connector body 812.

The radially inwardmost tips 840 of the inward-extending fingers 838 define an opening 842 sized and configured to be slightly smaller than an outer diameter of the aluminum shield 190 of a hardline coax cable. When the aluminum shield 190 is pushed through the opening 842 of the first washer 818, the inward-extending fingers 838 can bend in the longitudinal direction toward the second end 826 of the first connector body 812 to accommodate the slightly larger aluminum shield 190. Once the first connector body 812 receives a portion of the aluminum shield 190, the resiliency of the inward-extending fingers 838 urges the inward-extending fingers 838 radially inward toward the aluminum shield 190 to provide a gripping force against the aluminum shield 190. The gripping force of the inward-extending fingers 838 together with the angled orientation of the inward-extending fingers 838 helps to prevent the first connector body 812 from being removed from the aluminum shield 190 and increases the insertion force required to push the aluminum shield further through the cavity 130. Meanwhile, the rotatability of the first ring member 816 and the first washer 818 permits a user to rotate the aluminum shield 190 as it is pushed further through the opening 842, which may facilitate easier insertion of the aluminum shield 190 through the inward-extending fingers 838. The gripping force of the inward-extending fingers 838 causes the first washer 818 and first ring member 816 to rotate with the aluminum shield 190, which prevents damage to the aluminum shield 190 that would otherwise be caused by relative rotation between the aluminum shield 190 and the inward-extending fingers 838.

Even before the first washer 818 is sandwiched between the first and second ring members 816, 820, the inward-extending fingers 838 and outward-extending fingers 839 of the first washer 818 provide a continuous ground path from the aluminum shield 190 of the hardline cable, through the first washer 818, and to the first connector body 812. That is, although the first washer 818 may rotate with the first ring member 816 relative to the first connector body 812, the continuous ground path is maintained.

When the first and second ring members 816, 820 are assembled with the connector body 812 such that the annular portion 836 of the first washer 818 is firmly held in place, or sandwiched, along the longitudinal dimension, electrical continuity through the first and second ring members 816, 820 and the first washer 818 is provided. However, because of the resiliency of the inward-extending fingers 838 and outward-extending finger(s) 839, portion of the first washer 818 are able to move in the longitudinal and radial directions even when the first washer 818 is firmly held in place, or sandwiched, by the first and second ring members 816, 820. The first washer 818 may be substantially centered relative to the cavity 830 and the through hole 824 or, because of the resiliency of the outward-extending fingers 839, the first washer 818 may be radially offset relative to the longitudinal center of the cavity 830 and the through hole 824.

Thus, the first washer 818 maintains a continuous ground path from the aluminum shield 190 of the hardline cable, through the first washer 818, and to the first connector body 812 and prevents the aluminum shield 190 from backing out of the first connector portion 810 before and after being sandwiched between the first and second rings 816, 820. Meanwhile, the resiliency of the first washer 818 that permits longitudinal and radial movement of the inward-extending fingers 838 and outward-extending fingers 839, respectively, reduces the cable insertion force that is required to insert the aluminum shield 190 of the hardline cable into the first connector portion 810.

The first connector body 812 includes a second shoulder 834 at an end of the cavity 830 opposite to the first shoulder 832. The second shoulder 834 is spaced from the female threaded portion 828 in the longitudinal dimension of the first connector body 812, but a gap 835 between the female threaded portion 828 and the first connector body 812 is smaller than the gap 135 illustrated in the first embodiment. The second ring member 820 may extend from the cavity 830 beyond the second shoulder 834.

The first and second connector portions 810, 150 may be coupled to one another via the female threaded portion 838 of the first connector body 812 that receives the male threaded portion 168 of the second connector body 152. The first and second connector bodies 812, 152 may include hexagonal outer surfaces to facilitate tightening of the coupling between the first and second connector bodies 812, 152. When the first and second connector portions 810, 150 may be coupled to one another, the third seal 155 is sandwiched between the head 153 of the second connector body 152 and a longitudinal flange 813 of the first connector body 812 to provide a weatherproof seal between the first and second connector bodies 812, 152. Meanwhile, upon installation, the first seal 814 cooperates with an outer surface of the aluminum shield 190 to provide a weatherproof seal, and the second seal 154 cooperates with an outer surface of the tubular member 192 to provide a weatherproof seal.

In use, the connector 800 is utilized during a process for removing the core (i.e., the center conductor and dielectric) from inside of a hardline coaxial cable to create an open conduit. The connector 800 is then also utilized to facilitate injection of fiber optic cable into the conduit. For example, at a pedestal location, two connectors 800 can be attached to coax ends of two coax runs, and the connectors 800 can facilitate installation of a looping tube between the two coax runs.

The first connector body 812 is installed on a coax end of a first run of hardline cable by pushing the aluminum shield 190 through the through hole 824. The second shoulder 134 and/or the second ring member 120 can serve as an installation guide that indicates how far to push the connector onto the aluminum shield 190. A hydraulic fitting (not shown) may be coupled to the first connector body 812 to facilitate the ejection of the center conductor and dielectric. Once the center conductor and dielectric are ejected from the hardline cable, only the aluminum shield 190 remains. The hydraulic fitting is then removed from the first connector body 812.

The second connector body 152 is then threadably connected with the first connector body 812. After the first and second connector bodies 812, 152 are assembled together, a first end of the tubular member 192 is inserted through the through hole 164 of the second connector body 152. An inner diameter of the fourth ring member 160 can help guide the tubular member 192 to be inserted into the aluminum shield 190. The aluminum shield 190 has an inner diameter sized to receive the tubular member 192.

A second connector 100, 800 is similarly installed on a second run of hardline cable. A second end of the tubular member 192 is inserted into the second connector 100 and into the aluminum shield of the second run of hardline cable. Fiber optic cable can then be injected through the first run of cable, through the tubular member, and through the second run of cable. The first connector body 812 has a ground screw used to connect a ground path between the two connectors 100, 800 in each pedestal.

At any time after installation of the two connectors 100, 800, the tubular member 192 can be cut between the first and second connectors 100, 800 to expose the fiber optic cables that are in the runs of the aluminum shield 190. Because the second washer 158 permits one-way movement of the tubular member 192, the tubular member 192 can be pushed further into the aluminum shield 190 to unclutter the pedestal.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A connector, comprising:

a first connector body having a through hole configured to receive a conduit;

a first washer disposed in the first connector body, the first washer being configured to permit the conduit to be pushed in a first direction through the through hole while resisting movement of the conduit in a second direction opposite to the first direction;

a second connector body configured to be coupled to the first connector body, the second connector body having a through hole configured to receive a tubular member; and a second washer disposed in the second connector body, the second washer being configured to permit the tubular member to be pushed in the second direction through the through hole of the second connector body and into the second connector body while resisting movement of the tubular member in the first direction.

2. The connector of claim 1, wherein the first washer includes an annular portion that is axially and rotatingly fixed relative to the first connector body, and the second washer includes an annular portion that is axially and rotatingly fixed relative to the second connector body.

3. The connector of claim 1, wherein the first washer is configured to move in a radial plane relative to a longitudinal dimension of the first connector body and to rotate relative to the first connector body.

4. The connector of claim 1, wherein the first washer is sandwiched between a first ring member and a second ring member, and the first ring member and the first washer are configured to rotate relative to the first connector body.

5. The connector of claim 1, wherein the first washer includes radially inward-extending flexible fingers configured to define an opening sized and configured to be slightly smaller than an outer diameter of the conduit.

6. The connector of claim 5, wherein the inward-extending fingers are configured to provide a gripping force against the conduit, the gripping force being configured to allow the first washer to rotate with the conduit.

7. The connector of claim 1, wherein the first washer comprises a conductive metal and the conduit includes a conductive shield, and wherein the first washer is configured to provide a continuous ground path from the conductive shield through the first washer 818 and to the first connector body.

8. A connector, comprising:

a first connector body portion configured to receive a conduit;

a first washer disposed in the first connector body portion, the first washer being configured to permit the conduit to be pushed in a first direction into the first connector body portion while resisting movement of the conduit in a second direction opposite to the first direction;

a second connector body portion configured to be coupled to the first connector body portion, the second connector body portion being configured to receive a tubular member; and a second washer disposed in the second connector body portion, the second washer being configured to permit the tubular member to be pushed in the second direction into the second connector body portion while resisting movement of the tubular member in the first direction.

9. The connector of claim 8, wherein the first washer is axially and rotatingly fixed relative to the first connector body portion, and the second washer is axially and rotatingly fixed relative to the second connector body portion.

10. The connector of claim 8, wherein the first washer is configured to move in a radial plane relative to a longitudinal dimension of the first connector body portion and to rotate relative to the first connector body portion.

11. The connector of claim 8, wherein the first washer is sandwiched between a first ring member and a second ring member, and the first ring member and the first washer are configured to rotate relative to the first connector body portion.

12. The connector of claim 8, wherein the first washer includes radially inward-extending flexible fingers configured to define an opening sized and configured to be slightly smaller than an outer diameter of the conduit.

13. The connector of claim 12, wherein the inward-extending fingers are configured to provide a gripping force against the conduit, the gripping force being configured to allow the first washer to rotate with the conduit.

14. The connector of claim 8, wherein the first washer comprises a conductive metal and the conduit includes a conductive shield, and wherein the first washer is configured to provide a continuous ground path from the conductive shield through the first washer and to the first connector body portion.

15. A connector, comprising:

a first connector body portion configured to receive a conduit, the first connector body portion being configured to permit the conduit to be pushed in a first direction into the first connector body portion while resisting movement of the conduit in a second direction opposite to the first direction; and a second connector body portion configured to be coupled to the first connector body portion, the second connector body portion being configured to receive a tubular member, the second connector body portion being configured to permit the tubular member to be pushed in the second direction into the second connector body portion while resisting movement of the tubular member in the first direction.

16. The connector of claim 15, wherein the first connector body portion includes a washer configured to receive the conduit, the washer being configured to move in a radial plane relative to a longitudinal dimension of the first connector body portion and to rotate relative to the first connector body portion.

17. The connector of claim 16, wherein the washer is sandwiched between a first ring member and a second ring member, and the first ring member and the washer are configured to rotate relative to the first connector body portion.

18. The connector of claim 16, wherein the washer includes radially inward-extending flexible fingers configured to define an opening sized and configured to be slightly smaller than an outer diameter of the conduit.

19. The connector of claim 18, wherein the inward-extending fingers are configured to provide a gripping force against the conduit, the gripping force being configured to allow the washer to rotate with the conduit.

20. The connector of claim 16, wherein the washer comprises a conductive metal and the conduit includes a conductive shield, and wherein the washer is configured to provide a continuous ground path from the conductive shield through the washer and to the first connector body portion.

* * * * *